United States Patent [19]

Pagano

[11] 4,391,178

[45] Jul. 5, 1983

[54] LOGISTIC VEHICLE ARMOR

[75] Inventor: Victor H. Pagano, Oakland, Mich.

[73] Assignee: The United States of America as represented by the Secretary of the Army, Washington, D.C.

[21] Appl. No.: 243,287

[22] Filed: Mar. 13, 1981

[51] Int. Cl.[3] ..... F41H 7/00

[52] U.S. Cl. ..... 89/36 H; 89/36 A; 296/104

[58] Field of Search ..... 2/2.5; 89/36 R, 36 A, 89/36 C, 36 D, 36 F, 36 G, 36 H; 109/49.5, 82; 296/104, 105, 109

[56] References Cited

U.S. PATENT DOCUMENTS 558,812 4/1896 Hunt ..... 89/36 D 1,398,682 11/1921 De Dragic et al. ..... 109/82

3,061,839 11/1962 Foster ..... 2/2.5

FOREIGN PATENT DOCUMENTS 457752 6/1949 Canada ..... 296/104

*Primary Examiner*—Stephen C. Bentley

*Attorney, Agent, or Firm*—Peter A. Taucher; John E. McRae; Robert P. Gibson

[57] ABSTRACT

Protective covering for the cargo box of a military logistic vehicle. The basic fabric covering has special add-on pockets or sleeves for receiving alternative type of armor inserts (slats) for achieving various levels of ballistic hardening. Advantages of the system are easy armor adjustability or replaceability, and ability to remove the armor when it is not needed.

1 Claim, 6 Drawing Figures

LOGISTIC VEHICLE ARMOR

The invention described herein may be manufactured, used, and licensed by or for the Government for governmental purposes without payment to me of any royalty thereon.

BACKGROUND AND SUMMARY OF THE INVENTION

The military services utilize various size trucks, from one quarter ton up to approximately ten ton capacity, for cargo transportation purposes. Commonly the cargo is protected from rain, snow, wind etc. by means of a flexible fabric cover drapped over inverted U-shaped bows spaced along the length of the cargo box. A disadvantage with this system is that when the truck is used to transport military personnel the fabric cover provides no protection against enemy small arms fire or mortar fragments. I propose an add-on system of ballistic armor slats or plates for ballistically protecting personnel seated within the cargo area. In my proposed system the armor slats are located within horizontal fabric pockets or sleeves sewn or otherwise attached to the outer surface of the aforementioned fabric cover. The armor slats are removable and/or replaceable when it becomes necessary to lighten the vehicle for cargo-carrying purposes. Slat replacement is also envisioned as a means for periodically changing the armor material occasioned by materials technology improvements. This system overcomes armor weight penalty problems since the armor is used only when the vehicle has a relatively small load, i.e. humans; when heavy cargo is being transported the armor slats are removed to lighten the vehicle, to thus accommodate the higher payload.

THE DRAWINGS

Figure 1:
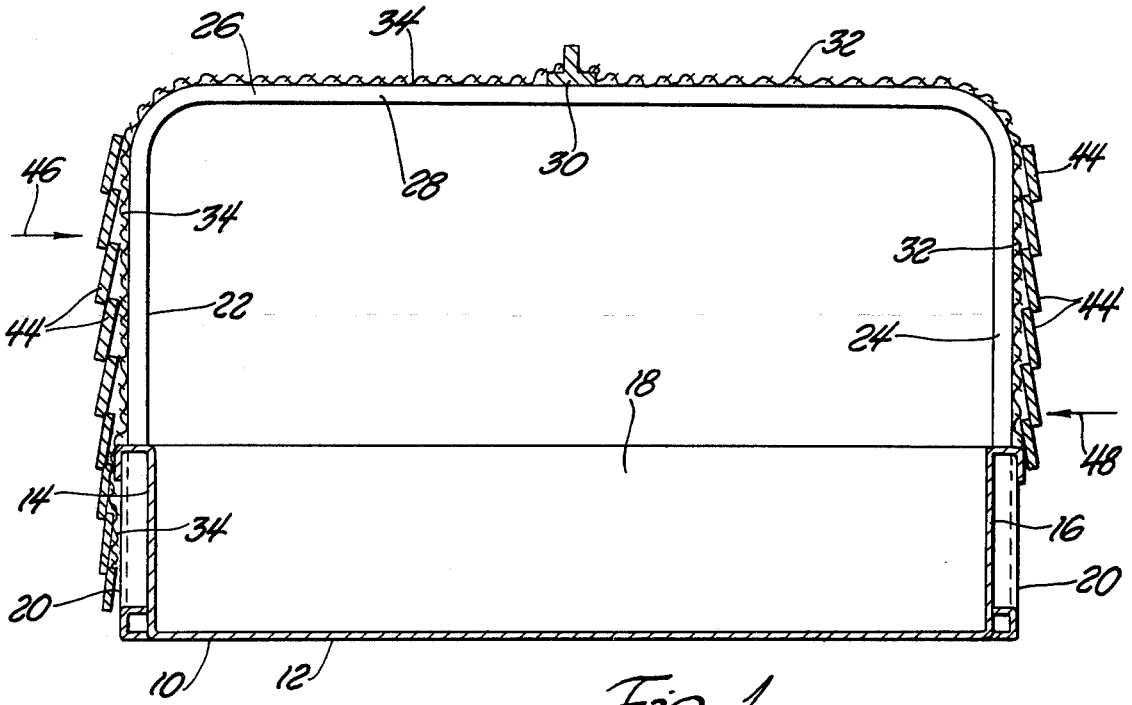
FIG. 1 is a transverse sectional view taken through a vehicle cargo box having one embodiment of my invention incorporated thereon.

Referring in greater detail to FIG. 1, there is shown a cargo box 10 for a conventional military vehicle. The box comprises a bottom wall 12, left side wall 14 and right side wall 16 constructed to support a series of inverted U-shaped bows 26 in known conventional fashion.

Bows 26 form a support framework for fabric covers 32 and 34 anchored to a center ridge pole 30. Each fabric cover is preferably formed of a material having ballistic properties, such as nylon or Kevlar. Each cover 32 or 34 is adapted to be unrolled from the FIG. 6 non-use condition to the condition of FIG. 1 wherein the individual covers extends horizontally along the upper surfaces of the bow roof sections 28 and thence downwardly along the outer surfaces of the bow leg sections 22 or 24 to overlap the box side walls 14 or 16.

Figure 5:
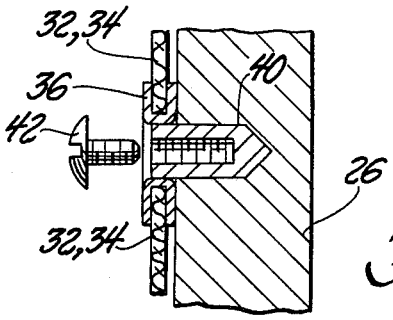
FIG. 5 illustrates an anchoring means usable in the FIG. 1 system for attaching the pocketed cover to the transverse bows.

Each cover 32 or 34 is provided with a number of annular grommets of the type shown at 36 in FIG. 5. The spacing of these grommets is such that individual grommets register with internally threaded sleeves 40 located at selected points along the length of a bow 26. As the respective cover is unrolled the grommets slip over the sleeves 40 on the bows. Thereafter individual screws 42 are threaded into sleeves 40 to affix the cover to the various bows 26 as a reasonably taught assembly. Elements 40 and 42 collectively form anchor systems for the cover.

My invention is directed particularly to a system of add-on ballistic armor elements 44 of slat-like configuration incorporated into cover 32 or 34 through built-in fabric pockets. Table I lists various armor material alternatives and protection levels achievable with the add-on armor elements 44.

TABLE I

MATERIAL DESIGN PERFORMANCE DATA

| DESIGN CONDITION | APPROX. WEIGHT (PSF) | PROTECTION (WEAPONS THREAT) | EST COST (1979) $/# |
|---|---|---|---|
| BASIC | | | |
| Nylon Cover (Alone) | 0.3 | Primarily Weather Protection | 2.30 |
| Nylon Blanket (.094#/ft$^2$/Ply) | 6.0 (with cover) | Mortar Fragments | 2.30 |
| Kevlar Blanket (.111#/ft$^2$/Ply) | 3.6 (with cover) | Mortar Fragments | 13.50 |
| INSERT ELEMENT (TYPE) | | | |
| REIN-FORCED (BONDED) | | | |
| Doron (10.5 PSF/in) | 11.0 | Medium attack distance small arms projectiles and artillery shell fragments. | 4.50 |
| Kevlar (6.67 PSF/in) | 8.0 | Medium attack distance small arms projectiles and artillery shell fragments. | 23.00 |
| CERAMIC-COMPOSITE | | | |
| $AL_2O_3$—Alum | 8.7 | Close attack distance small arms projectiles and artillery shell fragments. | expensive |
| $AL_2O_3$—Doron | 8.0 | Close attack distance small arms projectiles and artillery shell fragments. | expensive |
| $AL_2O_3$—Kevlar | 7.5 | Close attack distance small arms projectiles and artillery shell fragments. | expensive |
| $B_4C$—Doron | 6.2 | Close attack distance small arms projectiles and artillery shell fragments. | expensive |
| $B_4C$—Kevlar | 5.7 | Close attack distance small arms projectiles and artillery shell fragments. | expensive |

FIG. 1 shows armor slats 44 extending along the outer surface of each cover 32 or 34 to provide protection for personnel within the cargo box, particularly protection against enemy projectiles traveling in the directions designated by numerals 46 and 48. Coverage is enhanced by providing the slats along the cargo box side walls, as shown at the left portion of FIG. 1. Additional slats could be provided on the roof sections 28, particularily as protection against small arms fire from enemy aircraft and overhead artillery fragments.

Figure 2:
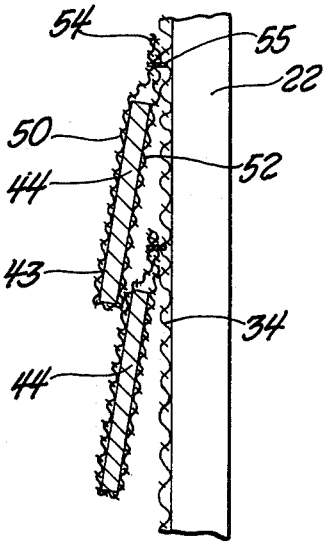
FIG. 2 is an enlarged sectional view of a fabric pocket construction used in the FIG. 1 embodiment of my invention.
Figure 3:
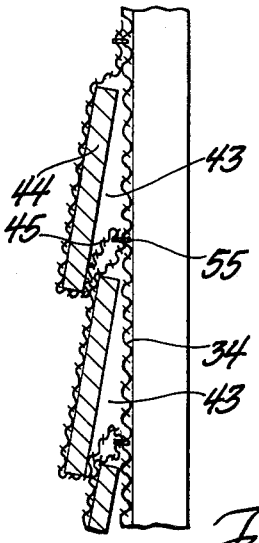
FIGS. 3 and 4 illustrate other pocket constructions that could be used in practicing my invention.
Figure 4:
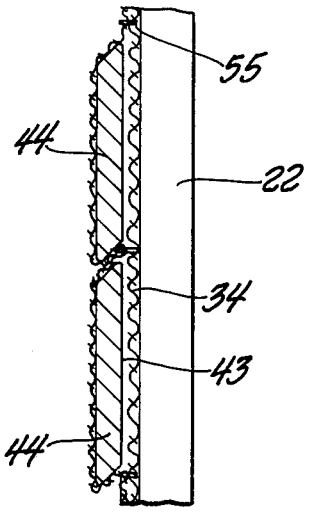

FIG. 1 is a diagrammatic illustration showing slats 44 attached directly to blanket 32 or 34. In actuality the slats are carried in horizontal fabric sleeves or pockets 43, as shown in FIGS. 2, 3 or 4. The sleeve structure of FIG. 2 includes two parallel fabric walls 50 and 52 having their upper edges joined together in flatwise relation to define a tab-like extension 54. The fabric sleeve may be joined or affixed to the associated blanket 34 (or 32) by means of stitch, gluing or the like at 55 on the tab-like extension 54. Preferably adjacent ones of the sleeves overlap one another as shown in FIG. 2 so that the armor elements 44 form a continuous uninterrupted ballistic envelope between the personnel within the cargo box and enemy projectiles.

FIG. 2 shows an arrangement wherein each fabric sleeve is formed separately from adjacent sleeves. FIG. 3 illustrates an alternate construction wherein a single length of fabric material is doubled underneath armor element 44 at 45 and then extended downwardly along the front face of the next lower armor element to form a multiplicity of pockets or sleeves 43 on the front face of the fabric cover 34.

FIG. 4 is generally similar to the arrangement shown in FIG. 3 except that the upper and lower edges of the armor elements 44 are beveled so that the lower edge of an upper armor element can extend in front of the upper edge of the next lower armor element. This is another way of enabling the armor elements to present a continuous armor envelope between the humans in the cargo box and the enemy projectiles. The FIG. 4 system has a lessened tendency for slats 44 to move up and down because each slat has an inherently tight fit in its support sleeve. This may be desirable from the standpoint of less noise and less wear and tear on the fabric.

The fabric sleeves or pockets 43 may be formed of any flexible material having the required strength and weathering resistance, such as canvas. Preferably the fabric for the sleeves has some ballistic property, as is possessed for example by certain woven fabrics containing nylon or Kevlar. The armor elements or slats 44 are preferably formed as a ceramic composite wherein the ceramic has a backing of a metal such as aluminum or a plastic reinforced fabric. The ceramic presents a hardened surface capable of defeating the enemy projectile. Preferred materials for the ceramic are alumina and boron carbide. The individual armor slats need not be formed of the same material. For example the slats along the roof could be of a different material than the slats at the sides of the cargo box. Slat material selection is also influenced by material technology advances that may be discovered during the life of the vehicle.

With relatively short cargo boxes the individual slats 44 can be the full length of the associated fabric pocket, whereby a single slat is insertable from one end of the pocket to occupy the full pocket length. With longer cargo boxes it may be more practical for individual slats 44 to form only a fraction of the length of the associated fabric pocket, in which case two or more slats 44 would occupy a given pocket in end-to-end relationship. The slats could be insertable through one or both ends of the fabric pocket. The open end of the pocket could be closed by means of a tie, locking strap, snap fastener, velcro fastener etc.

It will be noted that individual armor slats 44 extend horizontally rather than vertically. This is advantageous in that the weight of each slat is distributed over the entire length of each supporting sleeve. Loading per sleeve unit length is relatively small. Were slats 44 to extend vertically the weight of each slat would be concentrated on a relatively small fabric sleeve area equivalent to the slat end edge area; gravitational loadings on each sleeve would be relatively high, with consequent potential for early failure of the stitching or sleeve material. With the illustrated arrangement some of the slat weight is absorbed by the fabric covers; some slat weight is transferred through the fabric covers to the sleeve-type anchorage elements 40 (FIG. 5), thereby avoiding excessive loadings on lower areas of the fabric covers.

Figure 6:
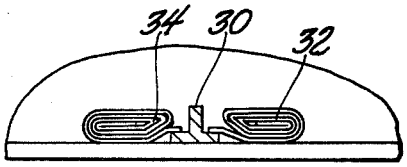
FIG. 6 is a fragmentary view showing the fabric covers of the FIG. 1 system in their rolled-up non-use conditions.

When it is desired to use the military vehicle for cargo-carrying purposes the individual armor slats 44 can be withdrawn from the fabric pockets, after which the various screws 42 shown in FIG. 5 can be removed to permit fabric covers 32 and 34 to be rolled up to the configurations shown in FIG. 6. Preferably an edge of each fabric cover 32 and 34 is anchored to ridge pole 30 by a fastener-grommet system similar to that shown in FIG. 5. Two or more straps may be trained around the rolled-up covers 32 and 34 to anchor them in their non-use storage positions.

This system offers some of the small arms fire protection provided by individual jackets or vests already used by the military. However, with the system shown in the attached drawings the individual armor elements 44 can be somewhat thicker than in the case of the vests or jackets because the weight of the armor does not have to be carried directly by the human soldier. Also, the illustrated system provides a versatile protective envelope which can be adjusted to different ballistic hardnesses for resisting conventional small arm fire and fragments from artillery and mortar fire.

I wish it to be understood that I do not desire to be limited to the exact details of construction shown and described for obvious modifications will occur to a person skilled in the art.

I claim:

1. In a military vehicle that includes a cargo box having side walls (14 and 16): the improvement comprising an inverted U-frame structure having a number of elevated bow roof sections (28) and downwardly extending leg sections (22 and 24) connected to the box side walls; a central ridge pole (30) extending between and normal to the bow roof sections on the longitudinal axis of the cargo box; two fabric covers (32 and 34) extending horizontally in opposite directions from the central ride pole and thence downwardly along the aforementioned leg sections at least to the upper edges of the cargo box side walls; means defining a number of horizontal hollow fabric sleeves on the downwardly extending portions of the fabric covers; each of the individual fabric sleeves being the same length in the horizontal direction as the associated cover; said fabric sleeves being open at their ends for enabling ballistic armor slats to be inserted into said sleeves; adjacent sleeves being overlapped on one another and being sufficient in number so that the sleeves collectively occupy the entire downwardly extending portion of each fabric cover; an elongated ballistic armor slat (44) insertable lengthwise into each fabric sleeve to provide ballistic protection for personnel occupying the cargo box; the fabric sleeves for each cover being formed from a single length of fabric material that is periodically doubled back on itself, each doubled back area being stitched to the fabric cover whereby the zones between adjacent stitched areas define the fabric sleeves; the individual armor slats having flat parallel faces and interconnecting longitudinal edges, opposite edges on individual slats being beveled so that edges on adjacent slats overlap one another when the slats occupy a given plane within the fabric sleeves; said armor slats being removable from the fabric sleeves, said covers being capable of being rolled up to a non-use storage position adjacent to the ridge pole when the slats are removed from the sleeves.

* * * * *